US010339816B2

(12) United States Patent
Sharma et al.

(10) Patent No.: US 10,339,816 B2
(45) Date of Patent: Jul. 2, 2019

(54) AUTOMATIC AIRCRAFT MONITORING AND OPERATOR PREFERRED REROUTING SYSTEM AND METHOD

(71) Applicant: The Boeing Company, Chicago, IL (US)

(72) Inventors: Vivek Sharma, Seattle, WA (US); John Allin Brown, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/317,797

(22) Filed: Jun. 27, 2014

(65) Prior Publication Data

US 2015/0379875 A1 Dec. 31, 2015

(51) Int. Cl.
*G08G 5/00* (2006.01)

(52) U.S. Cl.
CPC ..... *G08G 5/0039* (2013.01); *G08G 5/006* (2013.01); *G08G 5/0013* (2013.01); *G08G 5/0026* (2013.01); *G08G 5/0082* (2013.01); *G08G 5/0091* (2013.01)

(58) Field of Classification Search
None
See application file for complete search history.

(56) References Cited

U.S. PATENT DOCUMENTS 5,631,640 A * 5/1997 Deis ..... F41G 7/343 340/961
5,999,882 A * 12/1999 Simpson ..... G06Q 10/047 702/3
6,097,996 A * 8/2000 Deker ..... G05D 1/0202 701/10
6,160,497 A * 12/2000 Clark ..... G01S 7/04 340/945
6,289,277 B1 * 9/2001 Feyereisen ..... G01C 21/005 340/945
6,389,355 B1 * 5/2002 Gibbs ..... G08G 5/0021 434/38
6,571,166 B1 * 5/2003 Johnson ..... G08G 5/0021 340/972
6,604,044 B1 * 8/2003 Kirk ..... G08G 5/0043 701/1
6,744,382 B1 * 6/2004 Lapis ..... G01C 23/005 340/963
6,828,921 B2 * 12/2004 Brown ..... G08G 5/0086 340/945
7,483,790 B2 * 1/2009 Brent ..... G01C 23/005 701/122
7,813,845 B2 * 10/2010 Doose ..... G01C 21/26 340/951
7,835,825 B2 * 11/2010 Coulmeau ..... G01C 23/00 244/158.1

(Continued)

*Primary Examiner* — Jonathan M Dager
(74) *Attorney, Agent, or Firm* — Patterson + Sheridan, LLP

(57) ABSTRACT

An automatic aircraft monitoring and proposed rerouting system includes at least one processor and at least one memory. The at least one memory is in electronic communication with the at least one processor. The at least one memory includes programming code configured to be executed by the at least one processor. The programming code is configured to automatically monitor at least one aircraft and to automatically provide a proposed flight reroute for the at least one aircraft.

20 Claims, 4 Drawing Sheets

(56) References Cited

U.S. PATENT DOCUMENTS 7,925,394 B2 * 4/2011 Deker ..... G01C 21/00 244/175
7,979,199 B2 * 7/2011 Judd ..... G08G 5/0013 244/17.13
8,014,907 B2 * 9/2011 Coulmeau ..... G08G 5/0039 244/186
8,065,043 B2 * 11/2011 Gremmert ..... G05D 1/101 340/945
8,082,102 B2 * 12/2011 Ravenscroft ..... G01C 21/005 701/2
8,165,790 B2 * 4/2012 Bailey ..... G01W 1/08 340/901
8,280,626 B2 * 10/2012 Klooster ..... G08G 5/0013 701/3
8,285,427 B2 * 10/2012 Rogers et al. ..... 701/3
8,416,099 B2 * 4/2013 Bailey ..... G08G 5/0013 340/3.1
8,417,396 B2 * 4/2013 Goodman ..... G08G 5/0013 701/3
8,467,918 B2 * 6/2013 Lieu ..... G06Q 10/04 701/14
8,467,919 B2 * 6/2013 Klooster ..... G08G 5/0013 701/18
8,594,863 B2 * 11/2013 Coulmeau ..... G08G 5/0039 701/120
8,600,588 B2 * 12/2013 Del Amo Blanco ..... G08G 5/0034 701/14
8,606,491 B2 * 12/2013 Subbu ..... G06Q 10/047 701/120
8,781,651 B2 * 7/2014 Tino ..... G06Q 10/047 701/3
8,818,696 B2 * 8/2014 Klooster ..... G08G 5/0039 342/29
8,843,303 B1 * 9/2014 Young ..... G08G 5/0039 701/122
8,849,476 B2 * 9/2014 Coulmeau ..... G08G 5/0013 244/3.1
8,868,345 B2 * 10/2014 Lax ..... G08G 5/0091 702/189
8,942,914 B2 * 1/2015 Subbu ..... G08G 5/0013 701/120
9,043,043 B1 * 5/2015 Gribble ..... G05D 1/00 701/1
9,076,326 B2 * 7/2015 Maji ..... G08G 5/0021
9,098,997 B2 * 8/2015 Stewart ..... G08G 5/003
9,255,808 B2 * 2/2016 Andersson ..... G01C 21/3415
9,520,066 B2 * 12/2016 Spinelli ..... G08G 5/0021
9,536,435 B1 * 1/2017 Shay ..... G08G 5/045
9,558,670 B1 * 1/2017 Sheth ..... G08G 5/0013
2003/0122701 A1 * 7/2003 Tran ..... G01S 13/9303 342/29
2003/0146853 A1 * 8/2003 Bolduc ..... B64D 43/00 340/974
2005/0049762 A1 * 3/2005 Dwyer ..... G01C 23/00 701/3
2005/0156777 A1 * 7/2005 King ..... G01S 3/023 342/29
2005/0203675 A1 * 9/2005 Griffin, III ..... G01C 23/005 701/3
2005/0261808 A1 * 11/2005 Artini ..... G01C 23/00 701/3
2006/0089760 A1 * 4/2006 Love ..... G08G 5/0039 701/4
2006/0267748 A1 * 11/2006 Knoop ..... B60Q 9/008 340/435
2007/0043482 A1 * 2/2007 Aimar ..... G01C 23/00 701/4
2007/0129854 A1 * 6/2007 Sandell ..... G08G 5/0013 701/3
2007/0129855 A1 * 6/2007 Coulmeau ..... G08G 5/0039 701/3
2008/0059058 A1 * 3/2008 Caillaud ..... G05D 1/0202 701/467
2008/0065312 A1 * 3/2008 Coulmeau ..... G01C 23/00 701/122
2008/0288164 A1 * 11/2008 Lewis ..... G08G 5/0034 701/120
2009/0125221 A1 * 5/2009 Estkowski ..... G05D 1/104 701/120
2009/0157237 A1 * 6/2009 Bitar ..... G05D 1/101 701/3
2009/0179114 A1 * 7/2009 Conner ..... B64D 45/0015 244/189
2010/0030401 A1 * 2/2010 Rogers ..... G01C 23/00 701/3
2010/0100308 A1 * 4/2010 Coulmeau ..... G08G 5/006 701/122
2010/0114922 A1 * 5/2010 Gayraud ..... G08G 5/0021 707/758
2010/0152931 A1 * 6/2010 Lacombe ..... G01W 1/08 701/8
2010/0292871 A1 * 11/2010 Schultz ..... G01C 21/00 701/3
2010/0324812 A1 * 12/2010 Sacle ..... G01C 21/00 701/467
2010/0332056 A1 * 12/2010 Kirk ..... G01W 1/04 701/14
2011/0172914 A1 * 7/2011 Coulmeau ..... G08G 5/0034 701/532
2011/0208415 A1 * 8/2011 Mere ..... G08G 5/0039 701/123
2011/0313598 A1 * 12/2011 Coulmeau ..... G08G 5/0039 701/3
2012/0075124 A1 * 3/2012 Whitlow ..... G08G 5/0021 340/971
2012/0158219 A1 * 6/2012 Durling ..... G01S 5/0072 701/4
2012/0158278 A1 * 6/2012 Peinecke ..... G08G 5/045 701/120
2012/0215384 A1 * 8/2012 Fritz ..... G05D 1/0061 701/2
2013/0080043 A1 * 3/2013 Ballin ..... G08G 5/0034 701/120
2013/0238170 A1 * 9/2013 Klinger ..... G05D 1/104 701/3
2013/0345956 A1 * 12/2013 Struzik ..... G06Q 50/30 701/123
2014/0012500 A1 * 1/2014 Savarit ..... G08G 5/0039 701/527
2014/0142785 A1 * 5/2014 Fuentes ..... G05D 1/0011 701/2
2014/0156109 A1 * 6/2014 Estkowski ..... G05D 1/101 701/2
2014/0343761 A1 * 11/2014 Pastor ..... B64C 13/18 701/7
2014/0343765 A1 * 11/2014 Suiter ..... G08G 5/0056 701/18
2015/0269846 A1 * 9/2015 De Prins ..... G08G 5/0043 701/120

* cited by examiner

AUTOMATIC AIRCRAFT MONITORING AND OPERATOR PREFERRED REROUTING SYSTEM AND METHOD

FIELD OF THE DISCLOSURE

This disclosure relates to systems and methods for automatically monitoring at least one aircraft and rerouting the at least one aircraft with a goal of providing fuel, cost, time and environment benefits per the at least one aircraft operator's preferences.

BACKGROUND

Advances in the operational capabilities provided by avionics and Air Traffic Control ground systems have resulted in significant reductions in minimum separation standards in oceanic and remote airspace. These reductions have enabled more flexible and thus more efficient operations in this airspace, including the continuing reduction in the use of organized track structures. In many such tracts of airspace, airlines are able to specify, prior to flight, the route on which their aircraft operate and, provided aircraft and Air Traffic Control ground facilities are suitably equipped, dynamic airborne reroute procedures can be executed. However, very little advantage has been taken of the dynamic airborne reroute procedures capability.

In order to provide the flight crew with a dynamic airborne reroute procedure flight plan, the airline's dispatcher or flight planner must satisfy a wide range of regulatory, operational, and safety requirements. Although many airlines' ground systems are capable of satisfying the requirements, the planners' associated workload per re-route per flight is very high, and additional personnel resources are required to take any degree of benefit from dynamic airborne reroute procedures. Very few airlines have been able to make the business case for provision of the additional resources based on the level of benefit available.

At present, there are few solutions available to assist airlines in making informed requests of the air traffic service provider to reduce the operational inefficiencies resulting from preparation of dynamic airborne reroutes. In dynamic airborne reroute procedures, airlines' flight planners and dispatchers utilize flight planning systems iteratively to refine an optimal route in ways that satisfy all regulatory, operational, and safety requirements. This process is time-consuming and, even if additional planners are hired to absorb the additional workload, the time taken to deliver each reroute to the at least one aircraft in flight is long, and some of the benefit is thus lost. In addition, airlines have little or no knowledge of other traffic in the airspace, and are thus unable to provide conflict-free reroutes.

Where a reroute that the aircraft crew sends to Air Traffic Control as a request for clearance results in a traffic conflict, the controller either rejects the clearance or may offer an alternative. These alternatives are inevitably less beneficial and may require the crew to send the reroute flight plan back to the airline's flight planner to validate that all requirements are still met. This triggers an iteration of the reroute planning process with additional loss of benefit.

A system and method is needed to resolve one or more of the issues associated with the current practices employed to monitor and reroute aircraft.

SUMMARY

In one embodiment, an automatic aircraft monitoring and proposed rerouting system is provided. The automatic aircraft monitoring and proposed rerouting system includes at least one processor and at least one memory. The at least one memory is in electronic communication with the at least one processor. The at least one memory includes programming code configured to be executed by the at least one processor. The programming code is configured to automatically monitor at least one aircraft and to automatically provide a proposed flight reroute for the at least one aircraft.

In another embodiment, a non-transitory computer-readable medium is provided. The non-transitory computer-readable medium includes programming code. The programming code is configured to command at least one processor to automatically monitor at least one aircraft and to automatically provide a proposed flight reroute for the at least one aircraft.

In still another embodiment, a method of automatically monitoring and proposing a reroute for at least one aircraft is provided. In one step, at least one aircraft is automatically monitored. In another step, a proposed flight reroute for the at least one aircraft is automatically provided.

The scope of the present disclosure is defined solely by the appended claims, and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

The disclosure provides an automated system and method that proactively and dynamically optimizes airborne trans-oceanic, remote, polar, and domestic flight trajectories, subject to airspace and operational constraints (including traffic conflict avoidance, regulations, and airline policy), and using dynamic information including but not limited to environmental (weather), other traffic, and own aircraft state, thus enabling at least one airline to make better informed requests of the air traffic service provider for post-departure (either on ground or en route) re-routing. The disclosure receives triggers such as changes to winds and air temperatures, to significant environmental conditions like severe convective weather, to airline preferences, to airspace constraints, and to aircraft state information, and re-optimizes the aircraft's planned 4-dimensional trajectory in a way that takes account of the constraints and of known surrounding air traffic. The re-optimized plan is communicated to the at least one airline (or to the at least one aircraft) for use in dynamic airborne reroute procedures, providing environmental, operational, and economic benefits to the at least one airline. The re-optimized plan is computed based on aircraft operators' optimization preferences which may include one or more of: a cost optimal reroute; a fuel optimal reroute; a time optimal reroute; an environmentally beneficial reroute; an airspace constrained reroute; or an airport constrained reroute. The disclosure also allows for the pro-active and continual searching for optimum re-route opportunities for the at least one aircraft being monitored without requiring a manual optimization trigger by the at least one airline. For purposes of this disclosure, the term 'reroute' comprises a change in a flight's lateral path, a change in a flight's altitude, or a change in flight's speed, or any combination thereof.

Figure 1:
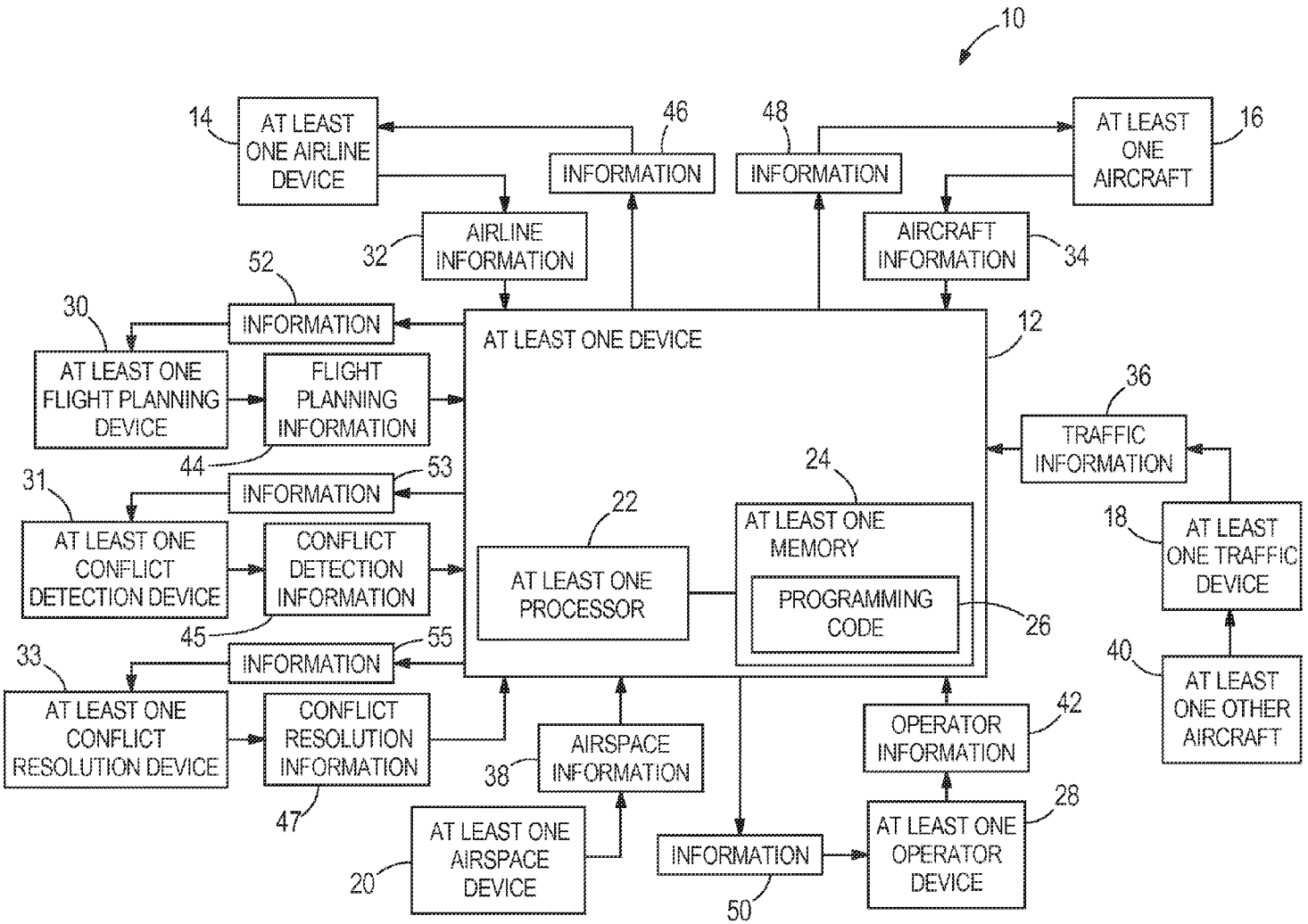
FIG. 1 illustrates a box diagram of one embodiment of an automatic aircraft monitoring and proposed rerouting system.

FIG. 1 illustrates a box diagram of one embodiment of an automatic aircraft monitoring and proposed rerouting system 10. The system 10 includes at least one device 12, at least one airline device 14, at least one aircraft 16, at least one traffic device 18, and at least one airspace device 20. In other embodiments, the system 10 may vary in the number, types, and functions of the devices contained in the system 10. The at least one device 12 includes at least one processor 22, at least one memory 24 in electronic communication with the at least one processor 22, programming code 26 contained in at least one memory 24 configured to be executed by the at least one processor 22, at least one operator device 28, at least one flight planning device 30, at least one conflict detection device 31, and at least one conflict resolution device 33. The at least one memory 24 may comprise a non-transitory computer readable medium which includes the programming code 26 which is configured to be executed by the at least one processor 22. The programming code 26 is configured to command the at least one processor 22 to automatically monitor the at least one aircraft 16 and to automatically provide a proposed flight reroute for the at least one aircraft 16.

The programming code 26 is configured to automatically provide the proposed flight route for the at least one aircraft 16 by automatically gathering and automatically considering airline information 32 provided by the at least one airline device 14, aircraft information 34 provided by the at least one aircraft 16, traffic information 36 provided by the at least one traffic device 18, and airspace information 38 provided by the at least one airspace device 20. In other embodiments, the programming code 26 may be configured to gather automatically and consider automatically any number or combination of the airline information 32 provided by the at least one airline device 14, the aircraft information 34 provided by the at least one aircraft 16, the traffic information 36 provided by the at least one traffic device 18, or the airspace information 38 provided by the at least one airspace device 20. In still other embodiments, the programming code 26 may be configured to automatically gather and automatically consider varying types of information from varying types of devices in order to automatically provide the proposed flight route for the at least one aircraft 16.

The airline information 32 provided by the at least one airline device 14 (which may comprise the airline of the at least one aircraft 16) comprises an aircraft flight to optimize, flight information, an airline preference, a customer request, a customer report, or an optimization trigger. In other embodiments, the airline information 32 provided by the at least one airline device 14 may vary in the number and types of information considered. The aircraft information 34 provided by the at least one aircraft 16 comprises a flight state, a flight intent, a reroute request, or a flight-crew preference. The at least one airline device 14 may collection and utilize one or both of statically available flight schedules and dynamically provided airline schedules. In other embodiments, the aircraft information 34 provided by the at least one aircraft 16 may vary in the number and types of information considered.

The traffic information 36 provided by the at least one traffic device 18 comprises a flight state of at least one other aircraft 40, and a flight intent of the at least one other aircraft 40. In other embodiments, the traffic information 36 provided by the at least one traffic device 18 may vary in the number and types of information considered. The airspace information 38 provided by the at least one airspace device 20 comprises an atmospheric condition, an airspace constraint, an airport adaptation, or an airspace adaptation. In other embodiments, the airspace information 38 provided by the at least one airspace device 20 may vary in the number and types of information considered.

The at least one operator device 28 is configured to receive information 50 from the at least one device 12 and to provide operator information 42 to the at least one device 12. The operator information 42 provided by the at least one operator device 28 comprises a system status, an optimization status, or a customer configuration. In other embodiments, the information 50 provided by the at least one device 12 to the at least one operator device 28 and the operator information 42 provided by the at least one operator device 28 to the at least one device 12 may vary in the number and types of information.

The at least one flight planning device 30 is configured to receive information 52 from the at least one device 12 and to provide flight plan information 44 to the at least one device 12. The at least one flight planning device 30 is configured to collect airline, aircraft, and airspace information needed to update current route and to compute new candidate reroutes. This function is designed to utilize either a built-in flight planning engine or an airline-specified flight planning engine. The flight plan information 44 provided by the at least one flight planning device 30 to the at least one device 12 comprises a computed flight plan, a conflict report, or a flight schedule. In other embodiments, the information 52 provided by the at least one device 12 to the at least one flight planning device 30 and the flight plan information 44 provided by the at least one flight planning device 30 to the at least one device 12 may vary in the number and types of information.

The at least one conflict detection device 31 is configured to receive information 53 from the at least one device 12 and to provide conflict detection information 45 to the at least one device 12. The at least one conflict detection device 31 is configured to collect airline, aircraft, and airspace information needed to probe a candidate reroute against traffic trajectories subject to airspace constraints. This function is designed to utilize either a built-in conflict detection algorithm or an airline or airline navigation service provider specified conflict detection algorithm. Additionally, the function can be configured to receive traffic data from one or more external sources. In other embodiments, the information 53 provided by the at least one device 12 to the at least one conflict detection device 31 and the conflict detection information 45 provided by the at least one conflict detection device 31 to the at least one device 12 may vary in the number and types of information.

The at least one conflict resolution device 33 is configured to receive information 55 from the at least one device and to provide conflict resolution information 47 to the at least one device 12. The at least one conflict resolution device 33 compiles a list of conflicts needed to propose resolution of these subject to airline and flight crew preferences. This function is designed to utilize either a built-in conflict resolution algorithm or an airline or airline navigation service provider specified conflict resolution algorithm. In other embodiments, the information 55 provided by the at least one device 12 to the at least one conflict resolution device 33 and the conflict resolution information 47 provided by the at least one conflict resolution device 33 to the at least one device 12 may vary in the number and types of information.

The at least one device 12 is configured to provide information 46 to the at least one airline device 14. The information 46 provided by the at least one device 12 to the at least one airline device 14 comprises a re-route advisory, an information request, an optimization status, or a custom message. In other embodiments, the information 46 provided by the at least one device 12 to the at least one airline device 14 may vary in the number and types of information.

The at least one device 12 is configured to provide information 48 to the at least one aircraft 16. The information 48 provided by the at least one device 12 to the at least one aircraft 16 comprises a re-route advisory. In other embodiments, the information 48 provided by the at least one device 12 to the at least one aircraft 16 may vary in the number and types of information.

The at least one device 12 is configured to provide information 50 to the at least one operator device 28. The information 50 provided by the at least one device 12 to the at least one operator device 28 comprises a system status, an optimization status, or a customer configuration. In other embodiments, the information 50 provided by the at least one device 12 to the at least one operator device 28 may vary in the number and types of information.

The at least one device 12 is configured to provide information 52 to the at least one flight planning device 30. The information 52 provided by the at least one device 12 to the at least one flight planning device 30 comprises a flight plan request, a conflict detection request, or a flight schedule request. In other embodiments, the information 52 provided by the at least one device 12 to the at least one flight planning device 30 may vary in the number and types of information.

Figure 2:
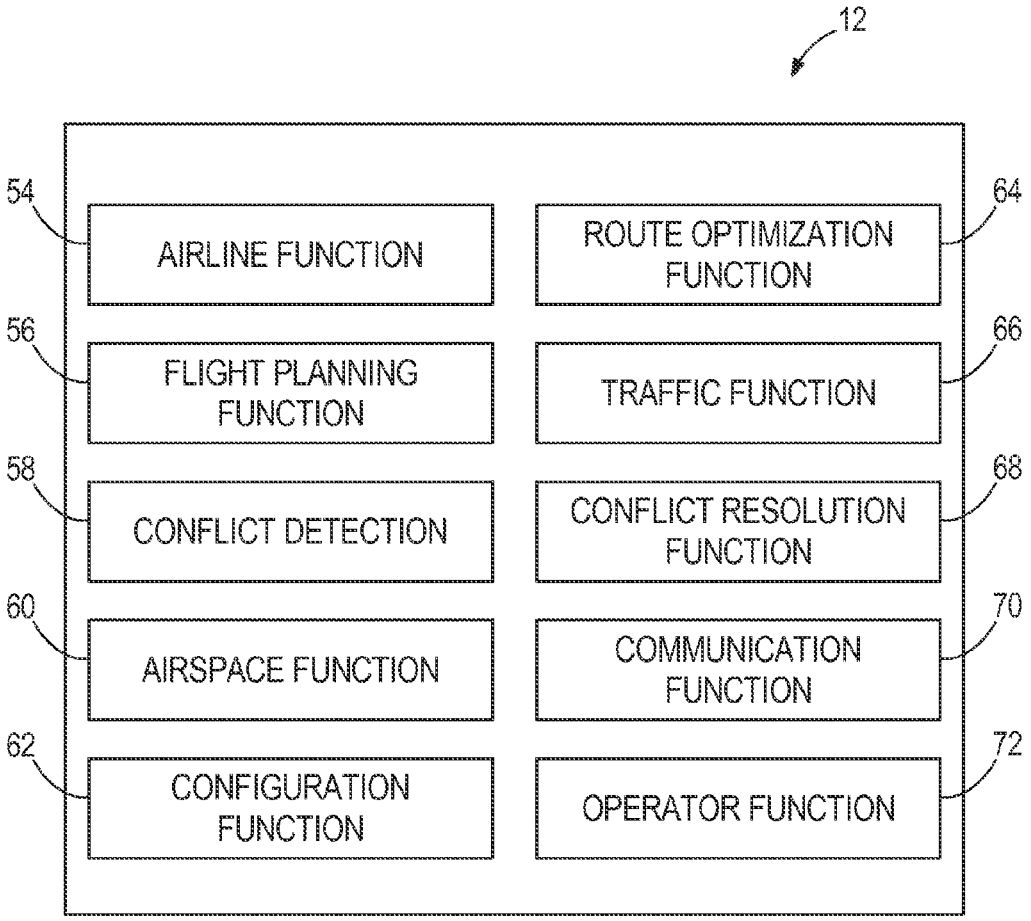
FIG. 2 illustrates a box diagram of one embodiment of a device showing the varying functions of the device.

FIG. 2 illustrates a box diagram of one embodiment of the at least one device 12 showing the varying functions of the at least one device 12. The at least one device 12 includes an airline function 54, a flight planning function 56, a conflict detection function 58, an airspace function 60, a configuration function 62, a route optimization function 64, a traffic function 66, a conflict resolution function 68, a communication function 70, and an operator function 72. In other embodiments, the functions of the at least one device 12 may vary in number and type.

The airline function 54 manages each airline's preferences and the required sets of flights and their attributes. In other embodiments, the airline function 54 may vary. The flight planning function 56 provides flight planning and other functions needed for system operations. In other embodiments, the flight planning function 56 may vary. The conflict detection function 58 automatically probes the computed reroutes against traffic trajectories and airspace constraints. In other embodiments, the conflict detection function 58 may vary. The airspace function 60 manages airspace information, and maintains a current picture of that environment. In other embodiments, the airspace function 60 may vary. The configuration function 62 allows the system operator/at least one operator device to configure the system for different airlines. In other embodiments, the configuration function 62 may vary.

The route optimization function 64 enables an internal or external optimization function to compute and re-compute routes automatically and proactively after a flight has departed to take into account cost benefit, environmental benefit, or other types of benefits. In other embodiments, the route optimization function 64 may vary. The traffic function 66 computes traffic trajectories and determines the set of traffic relevant to flights being optimized. In other embodiments, the traffic function 66 may vary. The conflict resolution function 68 resolves potential conflicts per airline, flight crew, and air navigation service provider preferences. In other embodiments, the conflict resolution function 68 may vary. The communication function 70 notifies the at least one airline or the at least one aircraft of reroute opportunities and associated environment and cost benefits. In other embodiments, the communication function 70 may vary. The operator function 72 performs system performance and operational analysis per system operator needs. In other embodiments, the operator function 72 may vary.

Figure 3:
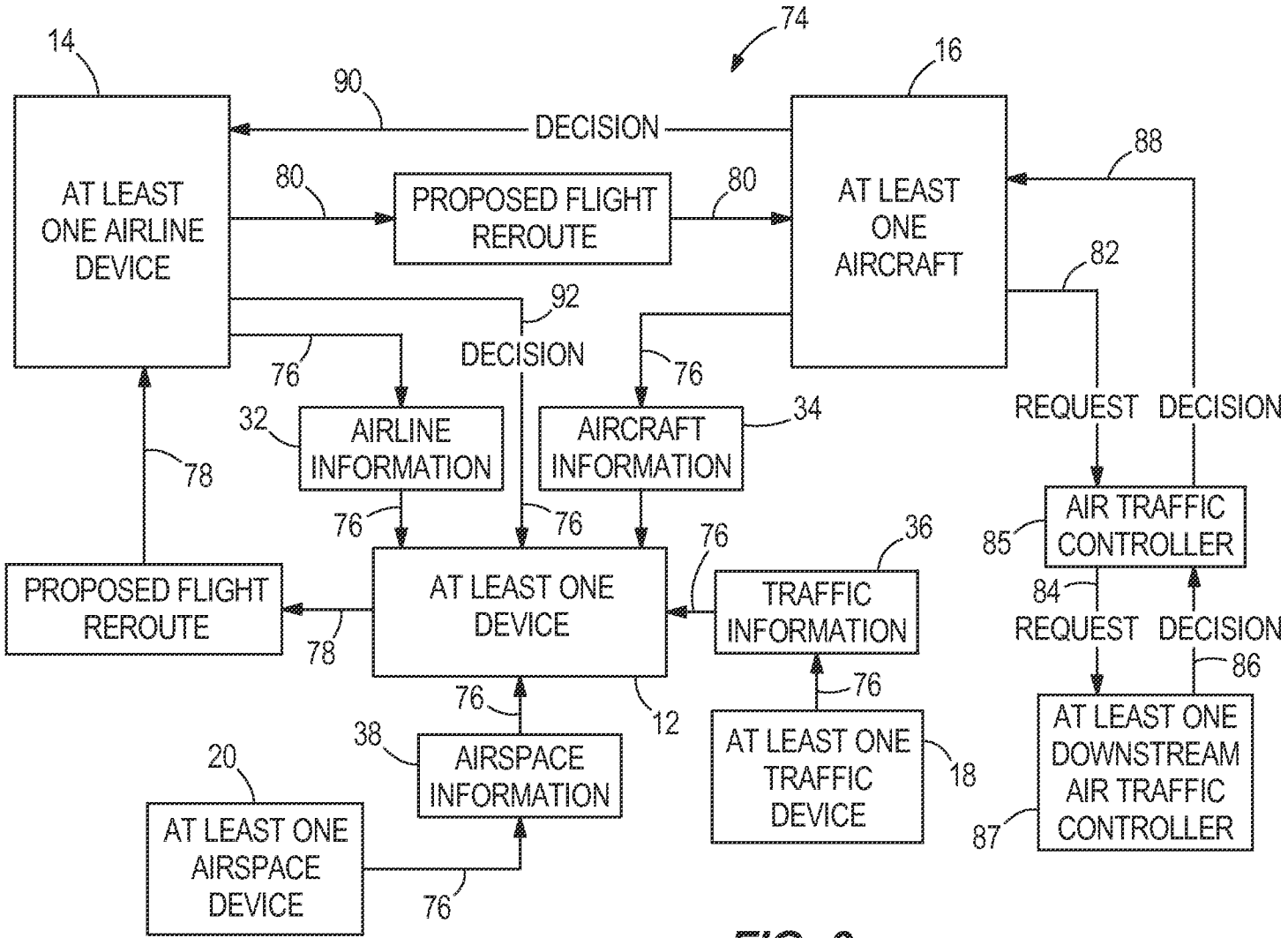
FIG. 3 illustrates a flowchart showing one embodiment of a method of automatically monitoring and proposing a reroute for at least one aircraft.

FIG. 3 illustrates a flowchart showing one embodiment of a method 74 of automatically monitoring and proposing a reroute for at least one aircraft 16. In step 76, the at least one device 12 automatically monitors the at least one aircraft 16 by automatically collecting airline information 32 from at least one airline device 14, aircraft information 34 from the at least one aircraft 16, traffic information 36 from at least one traffic device 18, and airspace information 38 from at least one airspace device 20. In step 78, the at least one device 12 automatically provides a proposed flight reroute for the at least one aircraft 16 to the at least one airline device 14. In step 80, the at least one airline device confirms viability of the proposed flight reroute and sends the proposed flight reroute to the at least one aircraft 16. In step 82, the at least one aircraft 16 determines viability of the proposed flight reroute and requests air traffic controller 85 for clearance to reroute the at least one aircraft 16 to the proposed flight reroute. In step 84, the air traffic controller 85 ensures the proposed flight reroute is conflict-free in his airspace and if so then coordinates the clearance with at least one downstream air traffic controller 87. In step 86, the at least one downstream air traffic controller 87 determines if the proposed flight reroute is conflict-free in his airspace and communicates his decision to the air traffic controller 85. In step 88, the air traffic controller 85 sends a message to the at least one aircraft 16 clearing the proposed flight reroute request. In step 90, the at least one aircraft 16 informs the at least one airline device 14 of the acceptance of the proposed flight reroute request or the rejection of the proposed flight reroute request. In step 92, the at least one airline device 14 informs the at least one device 12 of the acceptance of the proposed flight reroute request or the rejection of the proposed flight reroute request. In another embodiment, the at least one device 12 may communicate directly with the at least one aircraft 16. In still other embodiments, the method 74 may vary in the order of the steps, the substance of the steps, the number of the steps, may not follow one or more of the steps, or may follow one or more additional steps.

Figure 4:
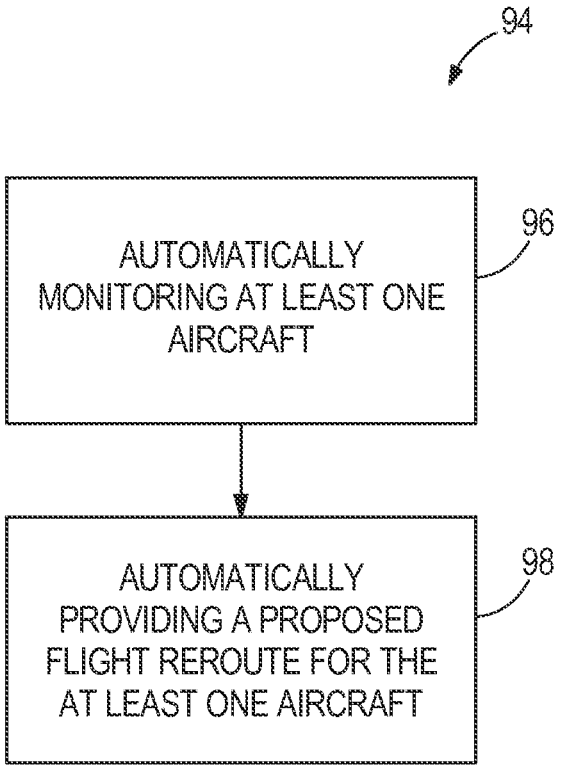
FIG. 4 illustrates a flowchart of another embodiment of a method of automatically monitoring and proposing a reroute for at least one aircraft.

FIG. 4 illustrates a flowchart of another embodiment of a method 94 of automatically monitoring and proposing a reroute for at least one aircraft. In step 96, at least one aircraft is automatically monitored. In one embodiment, step 96 comprises automatically monitoring the at least one aircraft on the ground. In another embodiment, step 96 comprises automatically monitoring the at least one aircraft in the air. In still another embodiment, step 96 comprises automatically gathering and automatically considering airline information, aircraft information, airspace information, and traffic information. In other embodiments, in step 96 any number or combination of the airline information, aircraft information, airspace information, traffic information, or other types of information may be automatically gathered and automatically considered.

The airline information comprises at least one aircraft flight to optimize, flight information, an airline preference, a customer request, a customer report, or an optimization trigger. In other embodiments, the airline information may vary. The aircraft information comprises a flight state, a flight intent, a reroute request, or a flight-crew preference of the at least one aircraft. In other embodiments, the aircraft information may vary. The airspace information comprises an atmospheric condition, an airspace constraint, an airport adaptation, or an airspace adaptation. In other embodiments, the airspace information may vary. The traffic information comprises a flight state of at least one other aircraft, and a flight intent of the at least one other aircraft. In other embodiments, the traffic information may vary.

In step 98, a proposed flight reroute for the at least one aircraft is automatically provided. In one embodiment, step 98 comprises automatically providing the flight reroute for the at least one aircraft directly to the at least one airline of the at least one aircraft. In another embodiment, step 98 comprises automatically providing the flight reroute for the at least one aircraft directly to the at least one aircraft. In other embodiments, the method 94 may vary in the order of the steps, the substance of the steps, the number of the steps, may not follow one or more of the steps, or may follow one or more additional steps.

One or more embodiments of the disclosure may have the following advantages. The system/method automatically monitors and automatically provides a proposed flight reroute for at least one aircraft. The system/method provides at least one airline or the at least one aircraft with not only the proposed flight reroute for the at least one aircraft but also with the benefit of the proposed flight reroute such as the fuel saved, the time saved, the environmental impact advantages, or other types of benefits of the proposed flight reroute over the current route of the at least one aircraft. The system/method provides a strategic route optimization which can change the currently filed flight plan by more than the tactical "cutting-corners" in the currently filed flight plan.

The system/method provides reroute data in a form suitable for immediate and automatic ingestion into an airline's flight planning system and avionics system. The system/method considers multiple flights optimization for a single airline as well as for multiple airlines, with each getting a commensurate/fair level of benefits using a rules-based equity algorithm. The system/method may specialize flight optimization ideas to oceanic, polar, and remote airspace where communications and surveillance are of lower quality and where separation standards are therefore greater. The system/method may not depend on the availability of real-time traffic surveillance data at some levels of service. The system/method may account for traffic of aircraft on fixed tracks, on flexible tracks, and on airline preferred routes.

The system/method may provide the optimal 4D entry point (fixed or flexible as appropriate to the airspace boundary) based on subsequent routing and other constraints, optimal routing from the entry point through the oceanic, polar and remote airspace transit, and an optimal exit point (fixed or flexible as appropriate to the airspace boundary) based on predicted traffic issues in subsequent continental airspace. The system/method may generate re-routes through multiple flight information regions and, where necessary, the route may be tailored based on the available ground infrastructure. The system/method provides a collaborative solution architecture that incorporates information available to the at least one flight crew, the at least one airline, and the at least one controller. The system/method may manipulate the 4-dimensional aircraft trajectory to search for an optimal re-route in terms of lateral path, vertical profile, and speed variations.

The system/method may present advisories which are free of conflict, within the constraints of the traffic data available, based on the state and intent of other aircraft, while respecting dynamic special use airspace restrictions, applicable flow constraints, and own aircraft performance capabilities and limitations (for instance, flight envelopes with current weight). The system/method may tailor advisories to account for the communication, navigation, surveillance, and automation capabilities (that can affect separation standards in use in the airspace) of the aircraft being monitored as well as of the relevant traffic aircraft. The system/method may tailor advisories to account for the communication, navigation, surveillance, and automation capabilities of an airline. The system/method may tailor advisories to account for the communication, navigation, surveillance, and automation capabilities of an air navigation service provider.

The system/method may provide guidance on when not to request an in-flight re-route. The system/method may provide guidance on how long to wait and which maneuver to perform before requesting an in-flight reroute, including In-Trail Procedure opportunity assessment. The system/method may propose a direct coupling of the airline trajectory optimization system, which in turn may be coupled to operational control systems (i.e. reservations, airframe usage and movement, crew movement, high-value passenger connection, etc.) so the business rules and preferences can be segregated from the air navigation service provider or other central planning agency, but will be taken into account with high fidelity.

The system/method automatically, proactively, and continually searches for optimum rerouting opportunities for the at least one aircraft (for flights such as trans-oceanic or other types of flights subject to airspace and operational constraints including traffic avoidance, regulations, and airline policy, and using dynamic information including but not limited to weather, other traffic, and own aircraft state) without requiring the at least one airline to manually do this upon a trigger such as an environmental condition, and thus enabling the at least one airline or the at least one aircraft to make better informed requests of the air traffic service provider for in-flight (or pre-flight) re-routing. This may provide beneficial reroutes independent of triggers such as changes in the weather. This may also identify changes in airspace constraints and provide reroutes that optimally avoid newly activated airspace or take beneficial advantage of unexpected deactivation of restrictions. This further reduces or eliminates the need for personnel, reduces costs associated with fuel, flight-time, and required personnel, increases customer preference, reduces the emission of greenhouse gases, allows more flights to take advantage of already reduced separation distances, and is more resource-efficient than current systems and methods. The system/method may further provide one or more additional types of advantages.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed element of subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. An automatic monitoring and proposed in-flight rerouting system for an airborne aircraft traveling to a destination via a current route, comprising:

at least one computer processor; and at least one memory storing a plurality of components of an application, the plurality of components executable by the at least one computer processor and comprising:

a route optimization function executable to: (i) receive updated information selected from updated airline information, updated aircraft information, updated airspace information, and updated traffic information; and (ii) responsive to receiving the updated information, automatically and proactively compute at least a first in-flight reroute to the destination for the airborne aircraft, by at least in part communicating with an operational control system specific to an airline associated with the airborne aircraft in order to consider reservations, airframe usage and movement, crew movement, and high-value passenger connection data;

a conflict detection function executable to automatically check the first in-flight reroute against traffic trajectories of other aircraft and airspace constraints for conflicts; and a conflict resolution function executable to, upon detection of one or more conflicts in the first in-flight reroute by the conflict detection function, automatically and proactively compute a second in-flight reroute in accordance with preferences selected from airline preferences, flight crew preferences, and air navigation service provider preferences, in order to resolve the detected one or more conflicts in the first in-flight reroute, wherein the second in-flight reroute is selected from a cost optimal reroute, a fuel optimal reroute, a time optimal reroute, an environmentally beneficial reroute, an airspace constrained reroute, and an airport constrained reroute, wherein the second in-flight reroute is characterized by a resource usage improvement relative to the current route, wherein the resource usage improvement is selected from cost saved, fuel saved, time saved, environmental impact, airspace impact, and airport impact;

wherein upon no conflict being detected in the second in-flight reroute by the conflict detection function, and further upon receipt of clearance from air traffic control to reroute the airborne aircraft based on the second in-flight reroute, the airborne aircraft is rerouted to the destination based on the second in-flight reroute, wherein the rerouted aircraft arrives at the destination after traveling according to the second in-flight reroute, which causes the resource usage improvement to be attained.

2. The system of claim 1, wherein the route optimization function automatically and proactively computes the first in-flight reroute based on dynamically changing airline information, dynamically changing aircraft information, dynamically changing airspace information, or dynamically changing traffic information.

3. The system of claim 2, wherein the at least one memory further stores an airline function executable to output the dynamically changing airline information, which comprises at least one aircraft flight to optimize, flight information, an airline preference, a customer request, a customer report, or an optimization trigger.

4. The system of claim 2, wherein the at least one memory further stores a flight planning function executable to output the dynamically changing aircraft information, which comprises a flight state, a flight intent, a reroute request, or a flight-crew preference.

5. The system of claim 2, wherein the at least one memory further stores an airspace function executable to output the dynamically changing airspace information, which comprises an atmospheric condition, an airspace constraint, an airport adaptation, or an airspace adaptation.

6. The system of claim 2, wherein the at least one memory further stores a traffic function executable to output the dynamically changing traffic information, which comprises a flight state of at least one other aircraft, and a flight intent of the at least one other aircraft.

7. A non-transitory computer readable medium including programming code of an application, the programming code configured to perform an operation to reroute an airborne aircraft traveling to a destination via a current route, the operation comprising:

receiving updated information selected from updated airline information, updated aircraft information, updated airspace information, and updated traffic information, wherein the updated information is received by a route optimization function of the application, the application having a plurality of components including the route optimization function, a conflict detection function, and a conflict resolution function;

responsive to receiving the updated information, automatically and proactively computing at least a first in-flight reroute to the destination for the airborne aircraft, by the route optimization function and by at least in part communicating with an operational control system specific to an airline associated with the airborne aircraft in order to consider reservations, airframe usage and movement, crew movement, and high-value passenger connection data;

subsequent to computing the first in-flight reroute to the destination, automatically checking, by the conflict detection function, the first in-flight reroute against traffic trajectories of other aircraft and airspace constraints for conflicts; and upon detecting, by the conflict detection function, one or more conflicts in the first in-flight reroute, automatically and proactively computing a second in-flight reroute by operation of at least one computer processor when executing the conflict resolution function, and in accordance with preferences selected from airline preferences, flight crew preferences, and air navigation service provider preferences, in order to resolve the detected one or more conflicts in the first in-flight reroute, wherein the second in-flight reroute is selected from a cost optimal reroute, a fuel optimal reroute, a time optimal reroute, an environmentally beneficial reroute, an airspace constrained reroute, and an airport constrained reroute, wherein the second in-flight reroute is characterized by a resource usage improvement relative to the current route, wherein the resource usage improvement is selected from cost saved, fuel saved, time saved, environmental impact, airspace impact, and airport impact;

wherein upon no conflict being detected in the second in-flight reroute by the conflict detection function, and further upon receipt of clearance from air traffic control to reroute the airborne aircraft based on the second in-flight reroute, the airborne aircraft is rerouted to the destination based on the second in-flight reroute, wherein the rerouted aircraft arrives at the destination after traveling according to the second in-flight reroute, which causes the resource usage improvement to be attained.

8. A computer-implemented method of automatically computing an in-flight reroute to a destination for an airborne aircraft traveling to the destination via a current route, the computer-implemented method comprising:

receiving updated information selected from updated airline information, updated aircraft information, updated airspace information, and updated traffic information; wherein the updated information is received by a route optimization function of an application, the application having a plurality of components including the route optimization function, a conflict detection function, and a conflict resolution function;

responsive to receiving the updated information, automatically and proactively computing at least a first in-flight reroute to the destination for the airborne aircraft, by the route optimization function and by at least in part communicating with an operational control system specific to an airline associated with the airborne aircraft in order to consider reservations, airframe usage and movement, crew movement, and high-value passenger connection data;

subsequent to computing the first in-flight reroute to the destination, automatically checking, by the conflict detection function, the first in-flight reroute against traffic trajectories of other aircraft and airspace constraints for conflicts; and upon detecting, by the conflict detection function, one or more conflicts in the first in-flight reroute, automatically and proactively computing a second in-flight reroute by operation of at least one computer processor when executing the conflict resolution function, and in accordance with preferences selected from airline preferences, flight crew preferences, and air navigation service provider preferences, in order to resolve the detected one or more conflicts in the first in-flight reroute, wherein the second in-flight reroute is selected from a cost optimal reroute, a fuel optimal reroute, a time optimal reroute, an environmentally beneficial reroute, an airspace constrained reroute, and an airport constrained reroute, wherein the second in-flight reroute is characterized by a resource usage improvement relative to the current route, wherein the resource usage improvement is selected from cost saved, fuel saved, time saved, environmental impact, airspace impact, and airport impact;

wherein upon no conflict being detected in the second in-flight reroute by the conflict detection function, and further upon receipt of clearance from air traffic control to reroute the airborne aircraft based on the second in-flight reroute, the airborne aircraft is rerouted to the destination based on the second in-flight reroute, wherein the rerouted aircraft arrives at the destination after traveling according to the second in-flight reroute, which causes the resource usage improvement to be attained.

9. The computer-implemented method of claim 8, wherein automatically computing the second in-flight reroute further comprises automatically providing the second in-flight reroute for the airborne aircraft directly to the airborne aircraft or directly to at least one airline of the airborne aircraft.

10. The computer-implemented method of claim 8, wherein the second in-flight reroute is automatically and proactively computed based on dynamically changing airline information, dynamically changing aircraft information, dynamically changing airspace information, or dynamically changing traffic information.

11. The computer-implemented method of claim 10, wherein the airline information comprises at least one aircraft flight to optimize, flight information, an airline preference, a customer request, a customer report, or an optimization trigger.

12. The computer-implemented method of claim 10, wherein the aircraft information comprises a flight state, a flight intent, a reroute request, or a flight-crew preference.

13. The computer-implemented method of claim 10, wherein the airspace information comprises an atmosphere condition, an airspace constraint, an airport adaptation, or an airspace adaptation.

14. The computer-implemented method of claim 10, wherein the traffic information comprises a flight state of at least one other aircraft, and a flight intent of the at least one other aircraft.

15. The computer-implemented method of claim 8, wherein the resource usage improvement is determined and output, wherein the second in-flight reroute is computed based on one or more constraints specific to an airspace selected from oceanic, polar, and remote airspaces, the one or more constraints characterizing a minimum required measure of aircraft separation, that is greater than for airspaces not selected from oceanic, polar, and remote airspaces, wherein the minimum required measure is greater due to communication and surveillance being more restricted in measure relative to that for the airspaces not selected from oceanic, polar, and remote airspaces.

16. The computer-implemented method of claim 15, wherein the second in-flight reroute is computed based further on both: (i) newly activated airspace and (ii) unanticipated deactivation of one or more restrictions;

wherein the second in-flight reroute is automatically and proactively computed based on dynamically changing airline information, dynamically changing aircraft information, dynamically changing airspace information, and dynamically changing traffic information, wherein the plurality of components further includes an airline function and a flight planning function.

17. The computer-implemented method of claim 16, wherein the dynamically changing airline information is output by the airline function and comprises an aircraft flight to optimize, flight information, an airline preference, a customer request, a customer report, and an optimization trigger;

wherein the dynamically changing aircraft information is output by the flight planning function comprises a flight state, a flight intent, a reroute request, and a flight-crew preference.

18. The computer-implemented method of claim 17, wherein the plurality of components further includes an airspace function and a traffic function;

wherein the dynamically changing airspace information is output by the airspace function and comprises an atmosphere condition, an airspace constraint, an airport adaptation, and an airspace adaptation;

wherein the dynamically changing traffic information is output by the traffic function and comprises a flight state of at least one other aircraft, and a flight intent of the at least one other aircraft.

19. The computer-implemented method of claim 18, wherein the plurality of components further includes a communication function, configuration function, and an operator function;

wherein the resource usage improvement of the second in-flight reroute is output by the communication function;

wherein the application is reconfigurable for a plurality of distinct airlines via the configuration function;

wherein performance of the application is analyzed via the operator function;

wherein automatically computing the second in-flight reroute further comprises automatically providing the second in-flight reroute for the airborne aircraft, in respective instances: (i) directly to the airborne aircraft and (ii) directly to at least one airline of the airborne aircraft.

20. The computer-implemented method of claim 19, wherein the first in-flight reroute is computed based on the updated airline information, the updated aircraft information, the updated airspace information, and the updated traffic information;

wherein the second in-flight reroute is computed based on the airline preferences, the flight crew preferences, and the air navigation service provider preferences;

wherein the computed second in-flight reroute comprises, in respective instances, a cost optimal reroute, a fuel optimal reroute, a time optimal reroute, an environmentally beneficial reroute, an airspace constrained reroute, and an airport constrained reroute;

wherein the second in-flight reroute includes a change in each of a lateral path of the airborne aircraft, a flight altitude of the airborne aircraft, and a flight speed of the airborne aircraft;

wherein the resource usage improvement comprises, in respective instances, cost saved, fuel saved, time saved, environmental impact, airspace impact, and airport impact.

* * * * *